US005158298A

United States Patent [19]

Goins

[11] Patent Number: 5,158,298

[45] Date of Patent: Oct. 27, 1992

[54] HINGED GOLF TRAINING AID

[76] Inventor: Gary Goins, 6161 Sundown Dr., St. Petersburg, Fla. 33709

[21] Appl. No.: 823,166

[22] Filed: Jan. 21, 1992

Related U.S. Application Data

[63] Continuation-in-part of Ser. No. 721,152, Jun. 26, 1991.

[51] Int. Cl.[5] ..... A63B 69/36

[52] U.S. Cl. ..... 273/187.2; 273/189 A

[58] Field of Search ..... 273/183 B, 189 R, 189 A, 273/188 R, 190 R, 54 B; 128/879

[56] References Cited

U.S. PATENT DOCUMENTS

D. 234,434 3/1975 Trevino ..... 273/189 A X 3,606,342 9/1971 Albertson ..... 273/189 A

*Primary Examiner*—George J. Marlo

*Attorney, Agent, or Firm*—Dykema Gossett

[57] ABSTRACT

A unique golf training apparatus is disclosed in which an arm guide is secured to the off arm of a golfer. A wrist guide is pivotally attached to the arm guide and positioned on the hand of a golfer. The pivotal attachment of the wrist guide to the arm guide ensures that the golfer's hand pivots properly relative to the forearm. The golf training apparatus ensures the golfer's arm and hand are properly positioned during the swing, eliminating "open" or "closed" swings. In one embodiment, the pivotal attachment of the arm guide to the wrist guide is through a wide integral pivot which rotates as a unit with the wrist guide. This integral pivot extends for the majority of the lateral dimension of the arm guide. This ensures that the wrist guide does not flex relative to the arm guide while pivoting, and results in the golfer hitting the ball more properly.

13 Claims, 3 Drawing Sheets

HINGED GOLF TRAINING AID

BACKGROUND OF THE INVENTION

This application is a continuation-in-part of U.S. patent application Ser. No. 07/721,152, filed Jun. 26, 1991, still pending. This application relates to a golf training aid or apparatus to ensure that a golfer's arm and wrist work with a proper hinging action when swinging a golf club.

During a golf swing it is known that the position of the off arm is critically important in properly addressing and hitting the ball. By the "off arm", Applicant means the left arm for a right-handed golfer, or the right arm for a left-handed golfer. The off arm must remain relatively straight throughout the swing, and not bend at the elbow. Meanwhile, the hand must pivot relative to the arm during the back swing and follow through. It is important that the hand and arm pivot relative to each other in a plane which is generally perpendicular to the ground. If the hand is bent relative to the arm such that the club is angled towards the rear of the golfer, or towards the front of the golfer, the club head may be misaligned when the golfer follows through and strikes the golf ball. This results in a situation known as the club head being "open" or "closed", and is undesirable, resulting in hooks or slices.

Many golfers experience trouble in properly maintaining the wrists and arms in proper positions during the swing, and thus do not properly hit the ball. It is an object of the present invention to disclose a training aid for ensuring the golfer's hand and arm pivot properly during a swing.

SUMMARY OF THE INVENTION

A disclosed training aid includes an arm guide secured to the off arm of a golfer and a wrist guide positioned adjacent the hand of the golfer. The wrist and arm guides are pivotally attached to each other at a pivot point which is roughly aligned with the golfer's wrist.

The golfer begins the back swing and eventually reaches the highest point of the back swing. The wrist guide allows the golfer's hand to pivot relative to the arm guide in the proper plane, as described above. The wrist will not pivot in any other plane since the guides will prevent any such movement. The golfer continues with the swing by following through and striking the ball. During this follow through, the hand again pivots relative to the arm back to a generally aligned position. The wrist guide again pivots on the arm guide in the proper plane. This ensures that when the club strikes the ball it is moving in the proper direction. The club head will not be "open" or "closed".

In further features of the present invention, the arm guide is attached through hook and loop type strips to a user. The wrist guide is unattached to the hand of the user. Preferably, the arm guide is c-shaped and extends for more than 180 degrees about a central axis of the arm guide. This ensures the arm guide remains firmly secured to the golfer's arm. Further, the arm and wrist guides are preferably formed of two lamina with an outer lamina formed of a hard plastic shell, and an inner lamina formed of a softer, more resilient plastic which conforms to the individual shape of the user.

In a second embodiment of the present invention the wrist guide includes an integral pivot which extends through an aperture in the arm guide. The integral pivot ensures that the wrist guide is pivoting properly relative to the arm guide. Further, the integral pivot preferably extends for the majority of the lateral width of the arm guide at the pivot point. This ensures that the wrist guide will not flex relative to the arm guide while pivoting.

These and other features of the present invention will be best understood from the following specification and drawings of which the following is a brief description.

DETAILED DESCRIPTION OF A PREFERRED EMBODIMENT

Figure 1:
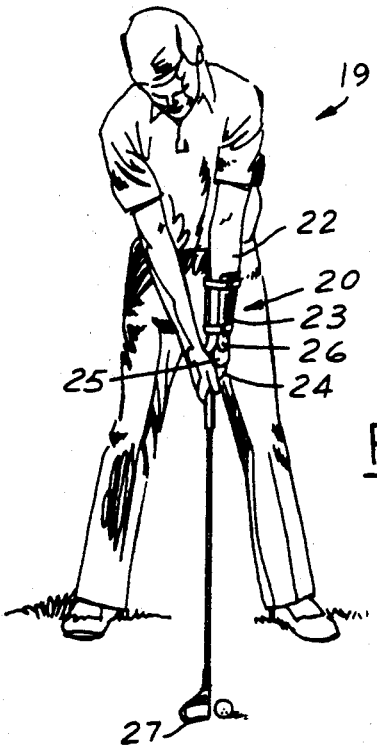
FIG. 1 is a view of a golfer wearing the present invention addressing a golf ball prior to a swing.

A typical golf swing is shown in FIGS. 1 through 4. Golfer 19 is wearing a hinged golf training aid or apparatus 20. The golfer is shown as a right-handed golfer, and thus the left, or off arm 22, wears training aid 20. An arm guide 23 is mounted on the left forearm 22. The golfer's left hand 24 wears wrist guide 25. Wrist guide 25 is pivotally attached to arm guide 23 at pivot point 26, roughly aligned with the golfer's wrist.

Figure 2:
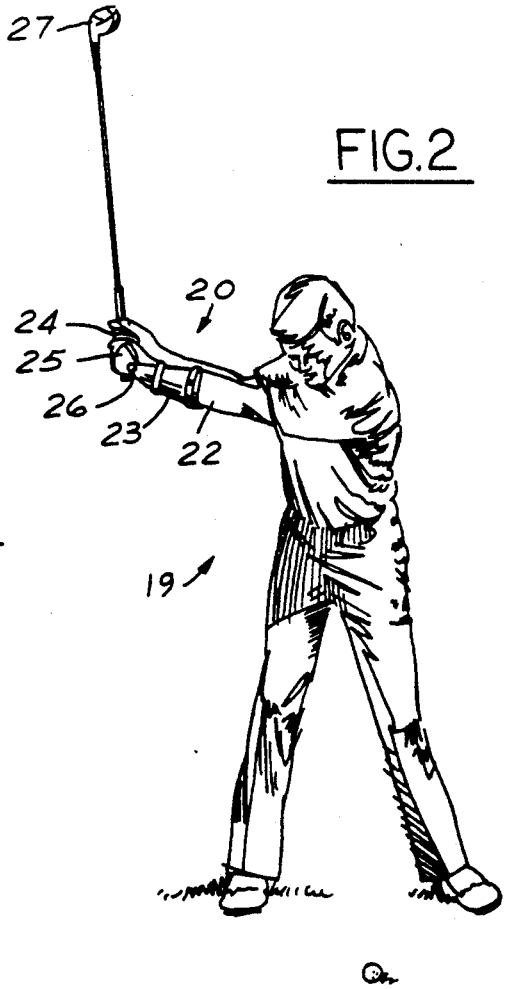
FIG. 2 is a view of the golfer during a back swing.

Golfer 19 is shown at the top of a back swing in FIG. 2. Left hand 24 has pivoted relative to left forearm 22, and wrist guide 25 has ensured that hand 24 pivots about pivot point 26. At this position it is desired that club and arm be generally in the same plane. That is, it is desirable for the golf club to generally lie in the plane of this figure. The problem discussed in the Background of the Invention section would result if the wrist breaks, and the club is angled into or out of the plane of this figure. The present invention prevents this from happening. This ensures that the pivoting of hand 24 relative to arm 22 is in the proper plane, and that the golfer's arm and hand are properly aligned at this point in the swing.

Figure 3:
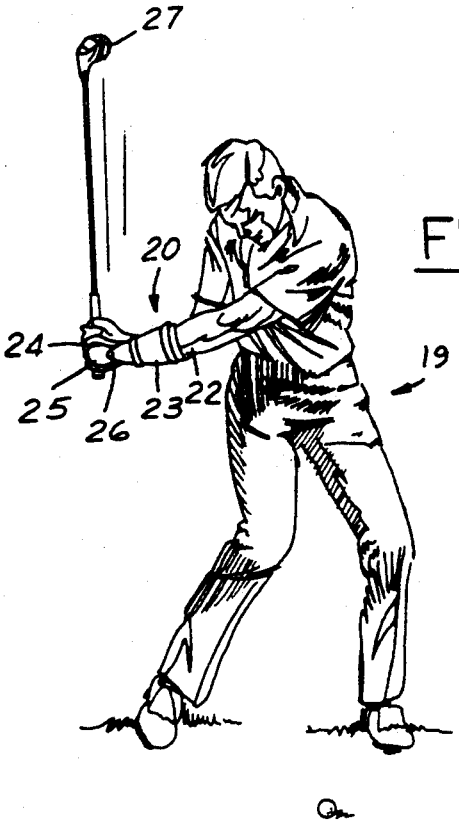
FIG. 3 is a view of the golfer beginning to follow through to strike a golf ball.

As shown in FIG. 3, golfer 19 is beginning the follow through. Hand 24 is pivoting towards an aligned position with left arm 22. Wrist guide 25 again ensures that hand 24 pivots in the proper plane.

Figure 4:
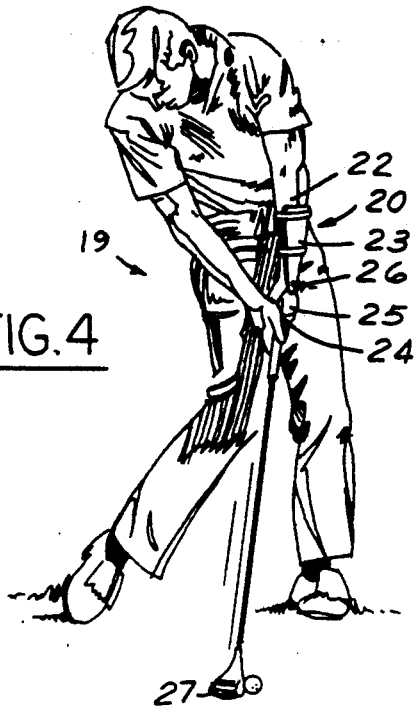
FIG. 4 is a view of the golfer immediately prior to striking a golf ball.

As shown in FIG. 4, golfer 19 is striking the ball. Arm guide 23 is aligned with wrist guide 25, ensuring the golfer's hand 24 and arm 22 are properly aligned. Club head 27 strikes the ball in the proper direction, and is neither "open" or "closed".

Figure 5:
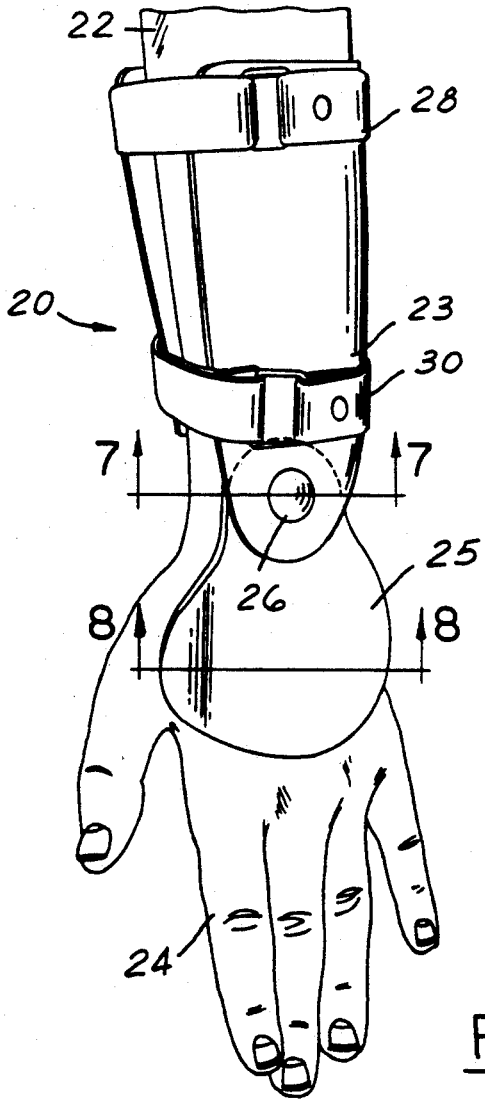
FIG. 5 is an enlarged view of a golf training aid or apparatus according to the present invention.

As shown in FIG. 5, golf training aid 20 includes arm guide 23 which is attached by hook and loop fastener strips 28 and 30 (which may be formed of Velcro TM ) to left arm 22. Wrist guide 25 is left unattached on the golfer's hand 24. A pivot point 26 is formed roughly aligned with the wrist of the golfer.

Arm guide 23 is c-shaped and extends for more than 180 degrees about a central axis of the arm guide. In this way, it ensures that the golfer's arm 22 is firmly secured to the arm guide 23 during the golf swing. This is especially important since wrist guide 25 remains unsecured to hand 24.

Figure 6:
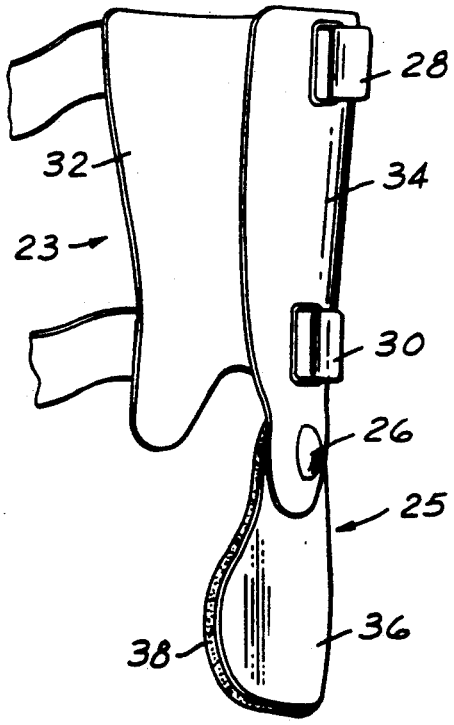
FIG. 6 is a perspective view of the golf training aid or apparatus.

FIG. 6 is a view of the golf training aid 20. Wrist guide 25 is pivotally attached to arm guide 23. Arm guide 23 includes an inner resilient material layer 32, and an outer hard plastic shell 34. Similarly, wrist guide 25 includes an outer hard plastic shell 26 overlying a softer resilient layer 38.

Figure 7:
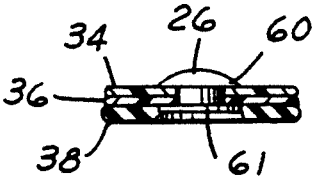
FIG. 7 is a cross-sectional view along line 7—7 as shown in FIG. 5.

FIG. 7 is a cross-sectional view through pivot point 26, showing the alignment of layers 34, 32 and 38. Pivot point 26 is tightly received within the layers 34, 36 and 38.

The pivot 26 is formed by a rivet having a head 60 and a base 61. Since layers 34 and 36 are roughly equal to the distance between the head and the base, arm guide 23 and wrist guide 25 tend to not flex about pivot point 26. Instead they are constrained to pivot about pivot point 26. Further, the fact that hard plastic shells 34 and 36 are in the vicinity of pivot point 26 also reduce flexing, which could result in improper pivoting. Although a single pivot point is illustrated, it should be understood that mating hand portions could be utilized on each side of the hand with separate pivot points.

Figure 8:
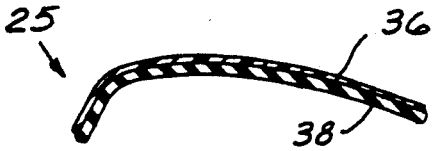
FIG. 8 is a cross-sectional view along line 8—8 as shown in FIG. 5.

FIG. 8 shows layers 36 and 38 of wrist guide 25.

Figure 9:
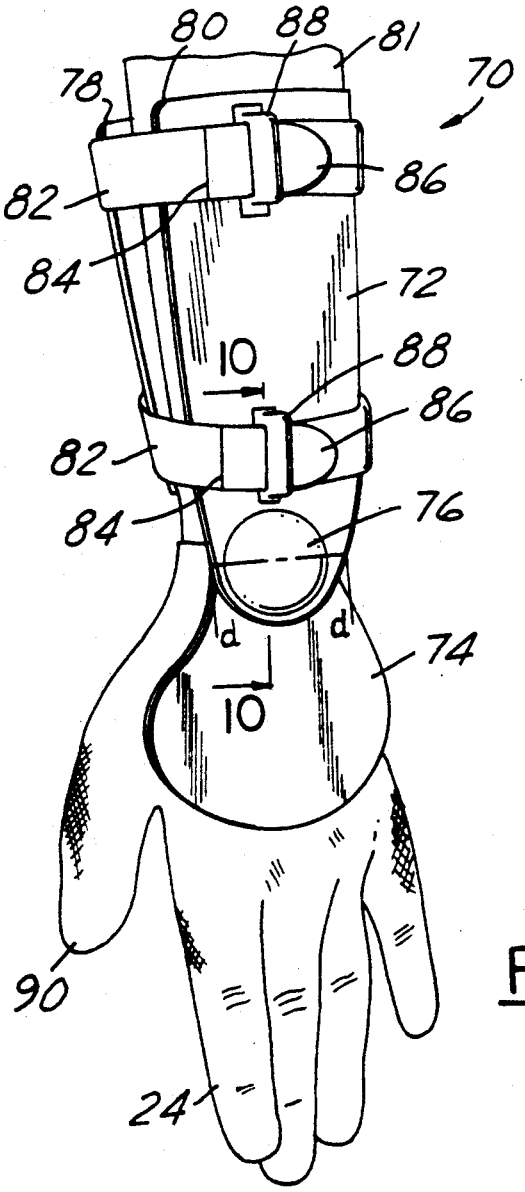
FIG. 9 is a perspective view of a second embodiment golf training aid according to the present invention.

FIG. 9 shows a second embodiment golf aid 70 according to the present invention. In training aid 70, arm guide 72 is pivotally attached to wrist guide 74 at pivot 76 which is integrally formed with wrist guide 74. A lateral dimension d-d is defined on arm guide 72 extending through a center of integral pivot 76 and generally perpendicular to an axis of the arm. As shown, integral pivot 76 extends for more than half of distance d-d. In this way, integral pivot 76 ensures that wrist guide 74 does not flex or twist relative to arm guide 72 during the golf swing.

As with the first embodiment, the circumferential extent between circumferential ends 78 and 80 of arm guide 72 is more than 180 degrees to ensure that the golfer's arm is securely retained by arm guide 72. Straps 82 secure arm guide 72 to the golfer's arm 81. Straps 82 are preferably of the type having a snap member 84 which is quickly secured with an end 86 of the belt then extending through a slot 88. Straps of this type are known and often used on ski boots. In this way, it is ensured that straps 82 are firmly secured to golfer's arm 81 quickly and easily, and with an easily adjustable amount of tension. Wrist guide 74 remains unsecured to the golfer's hand.

As shown, a golf glove 90 is preferably worn with training aid 70. Golf glove 90 ensures that wrist guide 74 does not move relative to the golfer's hand. Further, a golf glove may also be used with the first embodiment shown in FIGS. 1–8.

Figure 10:
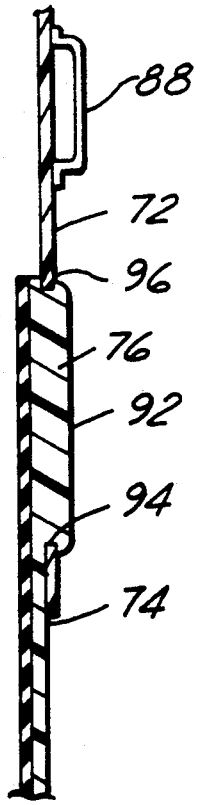
FIG. 10 is a cross-sectional view along line 10—10 as shown in FIG. 9.

As shown in FIG. 10, integral pivot 76 has an outer member 92 which extends through an aperture 94 in arm guide 72 and a central member 96 which pivots within aperture 94. Both the outer member 92 and central member 96 extend for more than half of distance d-d.

Due to the above-discussed features of this invention, it is ensured that a golfer's hand pivots properly relative to arm 22 during the back swing and follow through. If hand 24 begins to break at the wrist forwardly or rearwardly relative to the golfer, wrist guide 25 would prevent such movement. Even if the golfer's hand did overcome the resistance of wrist guide 25, there will be contact. This contact would give the golfer a signal that his wrist has broken and that such breaking is a problem which should be addressed.

Although wrist guide 25 lies in front of the golfer's hand at the top of the backswing, it also prevents the golfer's hand from breaking rearwardly about the wrist. If the golfer's hand begins to break rearwardly at the wrist a portion of the hand in the vicinity of the wrist does move forwardly. This portion would contact wrist guide 25, which prevents such movement.

In summary, golf training aid 20 ensures that the golfer's hand 24 pivots in the proper plane relative to the golfer's arm 22. After having worn golf training aid 20 for a period of time, the golfer will be trained to swing properly, and may no longer need training aid 20.

Preferred embodiments have been disclosed, however, a worker of ordinary skill in the art would recognize that certain modifications would come within the scope of this invention. For that reason the following claims should be studied in order to determine the true scope and content of this invention.

I claim:

1. A golf training apparatus comprising:

an arm guide to be secured to an arm of a golfer; and a wrist guide to be aligned with the hand of a golfer, said wrist guide having an integral pivot pivotally attached to said arm guide at a pivot axis such that said wrist guide and integral pivot may rotate as a unit relative to said arm guide.

2. The apparatus as recited in claim 1, wherein said pivot axis is adapted to be aligned with the golfer's wrist.

3. The apparatus as recited in claim 1, wherein a strap secures said arm guide to the golfer's arm.

4. The apparatus as recited in claim 3, wherein there are a pair of said straps, one being positioned near an end of said arm guide remote from said wrist guide and one being aligned immediately above said pivot axis.

5. The apparatus as recited in claim 4, wherein said wrist guide remains unsecured to the golfer's hand.

6. The apparatus as recited in claim 5, including a golf glove adapted to be worn with said wrist guide.

7. The apparatus as recited in claim 1, including a golf glove adapted to be worn with said wrist guide.

8. The apparatus as recited in claim 1, wherein both said wrist guide and said arm guide comprise a relatively hard outer plastic shell with a relatively resilient inner layer.

9. The apparatus as recited in claim 1, wherein a lateral axis of said arm guide may be defined extending perpendicular to the longitudinal axis of said arm guide, and said integral pivot extending for a first distance in said lateral dimension, said first distance being greater than one half of the lateral dimension of said arm guide at said pivot axis such that the pivotal attachment of said wrist guide to said arm guide is sufficiently rigid to ensure said wrist guide does not flex relative to said arm guide when pivoting.

10. The apparatus as recited in claim 1, wherein said wrist guide is disposed between said arm guide and a golfer's wrist, said integral pivot extending outwardly of said wrist guide and through an aperture in said arm guide.

11. The apparatus as recited in claim 10, wherein said integral pivot has an outer greater diameter portion received outwardly of said aperture in said arm guide, a slightly smaller diameter pivot portion received within said aperture in said arm guide.

12. The apparatus as recited in claim 1, wherein said arm guide is c-shaped in cross-section and extends along a longitudinal axis, and said arm guide extending for more than 180 degrees about said longitudinal axis.

13. A golf training apparatus comprising:

an arm guide to be secured to an arm of a golfer; and a wrist guide to be aligned with the hand of a golfer, said wrist guide having a pivot pivotally attached to said arm guide at a pivot access, such that said pivot and said wrist guide rotate relative to said arm guide, a lateral axis of said arm guide defined extending perpendicular to the longitudinal axis of said arm guide, and said pivot extending for a first distance in said lateral dimension, said first distance being greater than one-half of the lateral dimension of said arm guide at said pivot axis such that the pivotal attachment of said wrist guide to said arm guide is sufficiently rigid to ensure said wrist guide does not flex relative to said arm guide when pivoting.

* * * * *